US008766870B2

(12) United States Patent
Jung et al.

(10) Patent No.: US 8,766,870 B2
(45) Date of Patent: Jul. 1, 2014

(54) MULTIPLE FREQUENCY BAND ANTENNA AND ANTENNA SYSTEM USING THE SAME

(75) Inventors: Chang-won Jung, Hwaseong-si (KR); Young-eil Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1172 days.

(21) Appl. No.: 12/144,153

(22) Filed: Jun. 23, 2008

(65) Prior Publication Data

US 2009/0079647 A1 Mar. 26, 2009

(30) Foreign Application Priority Data

Sep. 21, 2007 (KR) ..... 10-2007-0096952

(51) Int. Cl.

| | |
|---|---|
| ***H01Q 3/24*** | (2006.01) |
| ***H01Q 1/38*** | (2006.01) |
| ***H01Q 5/00*** | (2006.01) |
| ***H01Q 13/00*** | (2006.01) |

(52) U.S. Cl.

USPC ..... 343/876; 343/700 MS; 343/767

(58) Field of Classification Search

USPC ..... 343/700 MS, 767, 795, 820, 821, 876

See application file for complete search history.

(56) References Cited

U.S. PATENT DOCUMENTS

| | | | | |
|---|---|---|---|---|
| 5,532,708 | A * | 7/1996 | Krenz et al. | 343/795 |
| 5,835,063 | A | 11/1998 | Brachat et al. | |
| 6,191,740 | B1 * | 2/2001 | Kates et al. | 343/700 MS |
| 6,339,404 | B1 * | 1/2002 | Johnson et al. | 343/794 |
| 6,664,931 | B1 * | 12/2003 | Nguyen et al. | 343/767 |
| 6,737,932 | B2 * | 5/2004 | Killen et al. | 333/35 |
| 6,801,168 | B1 * | 10/2004 | Yeh | 343/700 MS |
| 7,164,387 | B2 * | 1/2007 | Sievenpiper | 343/702 |
| 7,372,406 | B2 * | 5/2008 | Shiotsu et al. | 343/700 MS |
| 7,522,119 | B2 | 4/2009 | Jung et al. | |
| 7,538,736 | B2 * | 5/2009 | Kanno et al. | 343/767 |
| 7,619,578 | B2 * | 11/2009 | Kanno | 343/767 |
| 7,710,338 | B2 * | 5/2010 | Fujishima et al. | 343/767 |

(Continued)

FOREIGN PATENT DOCUMENTS

| | | |
|---|---|---|
| JP | 8-256009 A | 10/1996 |
| KR | 10-0742343 B1 | 7/2007 |

OTHER PUBLICATIONS

Korean Office Action issued Oct. 30, 2013 in counterpart Korean Application No. KR 10-2007-0096952 (9 pages, in Korean, with English language translation).

*Primary Examiner* — Robert Karacsony
(74) *Attorney, Agent, or Firm* — NSIP Law

(57) ABSTRACT

A multiple frequency band antenna is provided that includes a radiating unit having a slot formed on a first surface of the substrate that is closed at one end and open at the other end, and a feed unit formed on a second surface of the substrate to pass through an area on the second surface that corresponds with the same area on first surface between the center and the closed side of the slot. The feeding unit comprises at least one switch which adjusts the size of an area for feeding power to the antenna. The radiating unit is resonated in a plurality of frequency bands when the switch is turned off, and the radiating unit is resonated in a single frequency band which is different from the plurality of frequency bands when the switch is turned on. Consequently, an antenna is implemented for use in multiple frequency bands.

25 Claims, 6 Drawing Sheets

(56) References Cited

U.S. PATENT DOCUMENTS 7,710,407 B2 * 5/2010 Trent et al. ..... 345/173
7,808,433 B2 * 10/2010 Rutfors et al. ..... 343/700 MS
2007/0139286 A1 * 6/2007 Navsariwala et al. ..... 343/767
2008/0007478 A1 1/2008 Jung et al.

* cited by examiner

MULTIPLE FREQUENCY BAND ANTENNA AND ANTENNA SYSTEM USING THE SAME

CROSS-REFERENCE TO RELATED APPLICATIONS

This application claims the benefit under 35 U.S.C. §119 (a) from Korean Patent Application No. 10-2007-0096952, filed on Sep. 21, 2007, in the Korean Intellectual Property Office, the disclosure of which is incorporated herein by reference in its entirety.

TECHNICAL FIELD

The following description relates generally to wireless communication devices, and more particularly to tunable, multiple-frequency, miniature antennas for wireless communication devices and an antenna system using the same.

BACKGROUND

As wireless communication has developed, diverse wireless communication services, for example, the Global System for Mobile Communication (GSM), Personal Communication Services (PCS), World Interoperability for Microwave Access (WiMAX), Wireless Local Area Networks (WLAN), Wireless Broadband Internet (WiBro), and Bluetooth, have also been developed to be used in wireless devices, such as mobile phones, personal digital assistants (PDAs), personal computers, and laptop computers.

GSM uses 890-960 MHz band, PCS uses 1.8 GHz band, WiMAX uses 3.6-3.8 GHz band, WLAN of IEEE 802.11b uses 2.4 GHz band, Industrial Scientific & Medical (ISM) band, and WLAN of IEEE 802.11a uses 5 GHz band. Unlicensed National Information Infrastructure (UNII) band, WiBro uses 2.3 GHz band, and Bluetooth uses 2.4 GHz band.

Wireless communication services typically use an antenna for transmitting and/or receiving wireless communication signals. In a conventional wireless environment, wireless communication devices use diverse frequency bands. In order to provide wireless communication services via diverse frequency bands on a single wireless device, a conventional multi-band antenna system has been used. A conventional multi-band antenna system includes a plurality of antennas, a plurality of band pass filters (BPFs), and a plurality of radio frequency (RF) circuits. Each antenna transmits and/or receives signals in different frequency bands, and each BPF and RF circuit processes signals transmitted and received through each antenna. Therefore, a plurality of antennas is required which may increase the size of the antenna system.

SUMMARY

In one general aspect, an antenna includes a substrate having a first surface and a second surface; a radiating unit formed on the first surface of the substrate; a slot formed by the radiating unit that is closed at one end and open at the other end; and a feed unit formed on the second surface of the substrate in an area that corresponds to an area on the first surface of the substrate between the center of the length of the slot and the closed end of the slot.

The feeding unit may comprise at least one switch to configure the size of an area of the feed unit.

The radiating unit may include a ground unit formed on the first surface of the substrate; a slot forming unit formed on the first surface of the substrate at a predetermined distance from the ground unit to form the slot between the ground unit and the slot forming unit; and a connection unit to connect the slot forming unit and the ground unit and close an end of the slot.

The connection unit may extend from the ground unit to the slot forming unit at right angles to the slot forming unit and the ground unit.

The ground unit, the slot forming unit, and the connection unit may be an integral metal patterned unit.

The feed unit may include a first feed unit formed on the second surface of the substrate to correspond to at least one part of the slot forming unit on the first surface of the substrate; and a second feed unit formed in a bar shape on the second surface of the substrate and passes through an area that corresponds to an area of the first surface between the center of the length of the slot and the closed end of the slot, wherein the first feed unit is perpendicular to the second feed unit.

The feed unit may further comprise at least one switch to connect or disconnect the first feed unit to the second feed unit.

The switch may be a Positive Intrinsic Negative (PIN) diode.

The second feed unit may include a first section formed in relation to the ground unit; and a second section formed in the area on the second surface that corresponds to the area on the first surface between the center of the length of the slot and the closed end of the slot, wherein the width of the second section is less than the width of the first section.

The radiating unit may be resonated in a plurality of frequency bands when the switch is turned on, and the radiating unit is resonated in a single frequency band which is different from the plurality of frequency bands when the switch is turned off.

In another general aspect, an antenna system includes an antenna which includes a slot having a length a radiating unit to forms the slot; a feed unit positioned in relation to one side of the center of the length of the slot; and a switch to adjust the configuration of the feed unit; and a control unit to turn the switch on or off to resonate the antenna in a plurality of frequency bands when the switch is turned on, and to resonate the antenna in a single frequency band which is different from the plurality of frequency bands when the switch is turned off.

The antenna further includes a substrate having a first surface and a second surface, where the slot is formed on the first surface of the substrate and is closed at one end and open at another side, and the feed unit is formed on the second surface of the substrate and passes through an area that corresponds to an area on the first surface between the center of the length of the slot and a the closed end of the slot.

The radiating unit may include a ground unit formed on the first surface of the substrate; a slot forming unit formed at a predetermined distance from the ground unit to form the slot between the slot forming unit and the ground unit; and a connection unit which connects the slot forming unit and the ground unit and closes one end of the slot.

The connection unit may extend from the ground unit to the slot forming unit forming a right angle with the slot forming unit.

The ground unit, the slot forming unit, and the connection unit may be an integral metal patterned unit.

The feed unit may include a first feed unit formed on the second surface of the substrate to correspond to at least one part of the slot forming unit on the first surface of the substrate; and a second feed unit formed in a substantially rectangular shape on the second surface of the substrate and passes through an area that corresponds to an area on the first surface between the center and the closed end of the slot, wherein the first feed unit is perpendicular to the second feed unit, and the first feed unit and the second feed unit are connected or disconnected using the switch.

The second feed unit includes a first section which corresponds to the ground unit; and a second section which corresponds to the area between the center and the closed end of the slot on the first surface of the substrate, wherein the width of the second section is less than the width of the first section.

Other features will be apparent from the detailed description, drawings, and claims.

BRIEF DESCRIPTION OF THE DRAWINGS

Throughout the drawings and the detailed description, the same drawing reference numerals refer to the same elements, features, and structures.

DETAILED DESCRIPTION

The following detailed description is presented to provide the reader with a comprehensive understanding of the devices and systems described herein. Of course, various changes, modifications, and equivalents of the systems and methods described herein will suggest themselves to those of ordinary skill in the art. Also, description of well-known functions and construction are omitted to aid clarity and increase conciseness.

Figure 1:
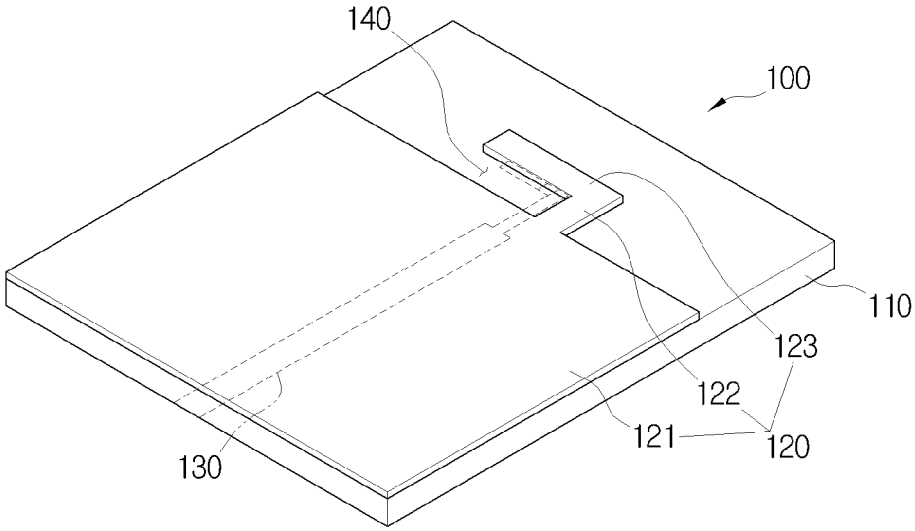
FIG. 1 is a configuration diagram illustrating an exemplary antenna for transmitting/receiving wireless communication signals.

FIG. 1 is a configuration diagram illustrating an exemplary antenna 100 for transmitting and/or receiving wireless communication signals. As illustrated in FIG. 1, the antenna 100 includes a substrate 110, a radiating unit 120, a feed unit 130, and a slot 140.

The substrate 110 may be implemented as a dielectric substrate such as a printed circuit board (PCB) including a first surface and a second surface. The first and second surfaces are spaced apart and opposite from each other in substantially parallel planes.

The radiating unit 120 is formed on the first surface of the substrate 110 to radiate electromagnetic waves.

The feed unit 130 is formed on the second surface of the substrate 110 to feed power to the radiating unit 120. More particularly, if an external electrical signal is applied to the feed unit 130, the feed unit 130 is coupled to the radiating unit 120 through the substrate 110, and thereby transmits electrical energy to the radiating unit 120. Consequently, the radiating unit 120 converts the energy into an electromagnetic wave and radiates the electromagnetic wave.

The radiating unit 120 forms a slot 140 to radiate the electromagnetic wave. In more detail, the radiating unit 120 includes a ground unit 121, a slot forming unit 123, and a connection unit 122.

The ground unit 121 is formed on the first surface of the substrate 110 as a thin film. FIG. 1 illustrates a ground unit 121 in a quadrangle form, but the ground unit 121 may be formed in other shapes, such as, for example, a circular or a polygonal shape, among others.

The slot forming unit 123 is positioned to one side of the ground unit 121 on the first surface to form the slot 140 between the slot forming unit 123 and the ground unit 121. In more detail, the slot forming unit 123 may be formed generally as a rectangle or a bar whose length is arranged substantially parallel to one side of the ground unit 121. The slot 140 also has two ends and a length substantially parallel to both the side of the ground unit 121 and the length of the slot forming unit 123. A centerline is formed midway between the ends of the slot 140 and is perpendicular to the length of the slot.

The slot forming unit 123 may be connected to the ground unit 121 using the connection unit 122. The connection unit 122 extends from the side of the ground unit 121 to the slot forming unit 123. The connection unit 122 may be substantially orthogonal to the ground unit 121 and the slot forming unit 123. The slot 140 is open at one end and closed at the other end by the connection unit 122. That is, one side of the connection unit 122 closes one end of the slot 140.

The feed unit 130 is formed on the second surface of the substrate 110. The feed unit 130 externally receives an electrical signal and is coupled with the radiating unit 120 to transmit electrical energy. The radiating unit 120 radiates the energy in an electromagnetic wave form in the air.

The feed unit 130 is positioned on the second surface of the substrate 110 in a specific relation to the radiating unit 120 on the first surface of the substrate 110. In particular, a portion of the feed unit 130 on the second surface is arranged pass to through an area on the second surface corresponding to an area on the first surface between the center line of the slot and the closed end of the slot 140. To this end, resonance is performed in a plurality of frequency bands so that the antenna functions as a multi-band antenna. As described above, the antenna may be directly manufactured on a conventional PCB to reduce manufacture and labor costs.

Figure 2:
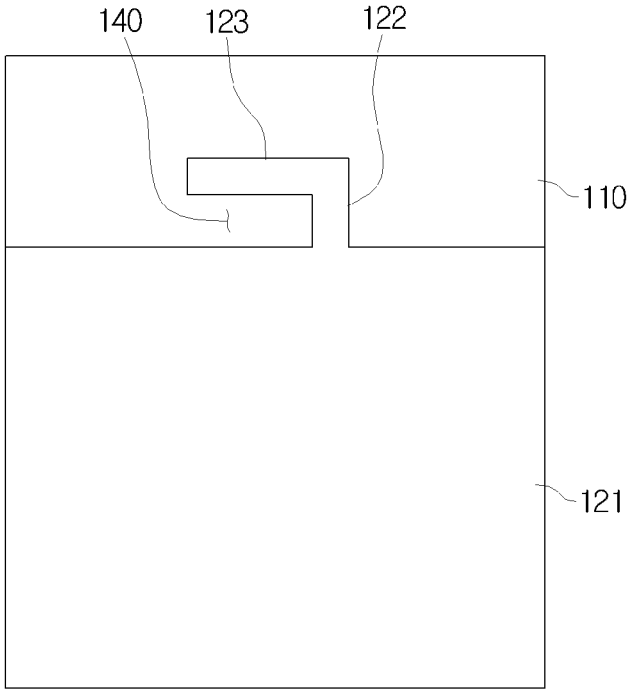
FIG. 2 is a first plane view of the exemplary antenna shown in FIG. 1.

FIG. 2 is a plane view illustrating a first surface of the exemplary antenna 100 shown in FIG. 1. On the first surface of the antenna, the radiating unit 120 is formed on the substrate with the remaining portion of the substrate 110 exposed.

The radiating unit 120 may be formed by patterning a metal film on the substrate 110 as shown in FIG. 2, wherein the ground unit 121, the connection unit 122, and the slot forming unit 123 may be integrally formed in a "⊏" shape. The length of the slot 140 may be $\lambda/4$. Accordingly, the ground unit 121, the connection unit 122, and the slot forming unit 123 function as a single monopole antenna.

The location and length of the connection unit 122 can vary as described herein. For example, the length between the location on first surface that corresponds with the location of a side of the feed unit 130 on the second surface closest to the closed end of the slot 140 and the closed side of the slot 140 may be 1, the length of slot 140 between the open end and the closed end may be 5, and the length of the connection unit 122 between the ground unit 121 and the slot forming unit may be 2. The length ratios may be changed according to frequency bands for usage.

Figure 3:
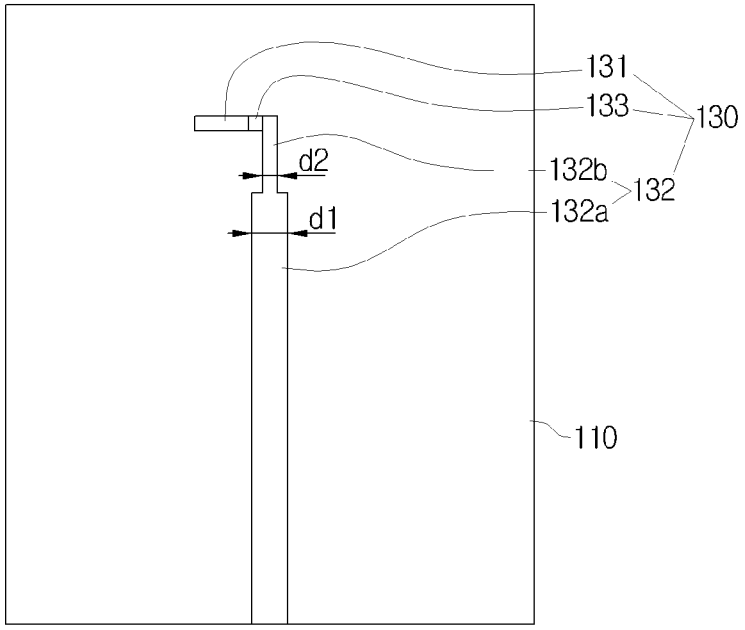
FIG. 3 is a second plane view of the exemplary antenna shown in FIG. 1.

FIG. 3 is a plane view illustrating a view of a second surface of the exemplary antenna shown in FIG. 1. The feed unit 130 is formed on the second surface of the substrate 110, including a first feed unit 131 and a second feed unit 132.

The first feed unit 131 is formed on the second surface of the substrate 110 at a location that corresponds to the slot forming unit 123 on the first surface of the substrate 110. More particularly, the first feed unit 131 may be positioned substantially parallel to the length of the slot forming unit 123.

The second feed unit 132 is formed on the second surface of the substrate 110 in relation to the ground unit 121 and the slot 140 on the first surface of the substrate 110, as explained in further detail below.

The second feed unit 132, as shown in FIG. 3, is generally rectangular or bar-shaped and may be connected to the first feed unit 131. As shown in FIG. 3, the second feed unit 132 includes a first bar section 132*a* and a second bar section 132*b*. The width d1 of the first bar section 132*a* may be greater than the width d2 of the second bar section 132*b*.

A switch 133 is formed between the first feed unit 131 and the second feed unit 132. The switch 133 is controlled using an external control signal to connect or disconnect the first feed unit 131 and second and 132. The switch 133 may be implemented, for example, as a Positive Intrinsic Negative (PIN) diode.

Figure 4:
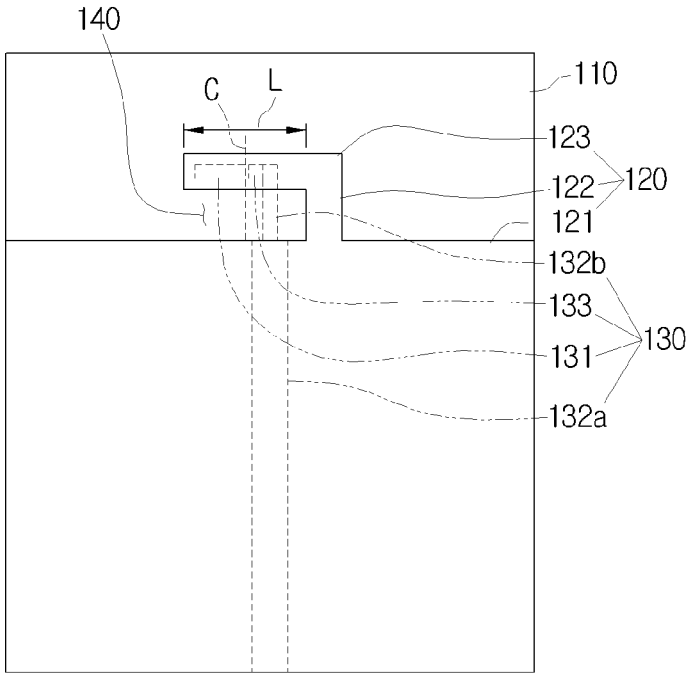
FIG. 4 is a projected figure illustrating more specifically the exemplary antenna shown in FIG. 1.

FIG. 4 is a projected figure illustrating the exemplary antenna shown in FIG. 1 to help illustrate the location of the feed unit 130 relative to the radiating unit 120 in more detail. As shown in FIG. 4, the radiating unit 120 is formed on the first surface of the substrate 110, and the feed unit 130 is formed on the second surface of the substrate 110 in substantially parallel planes that partially overlap each other.

The radiating unit 120 forms the slot 140. The length "L" of the slot may be $\lambda/4$. The slot 140 has a centerline "c" located midway between the ends of the slot 140. One end of the slot 140 is open, and the opposite end of the slot 140 is closed by the connection unit 122.

As shown in FIG. 4, the second bar section 132*b* of the second feed unit 132 of the feed unit 130 is located on an area of the second surface of the substrate 110 that substantially corresponds to or overlaps the same area as projected onto the first surface of the substrate 110 between the centerline "c" of the length of the slot 140 and the closed end of the slot 140. Accordingly, if the switch 133 is turned off, the first feed unit 131 and second feed unit 132 are separated, and thereby resonance is performed in a plurality of frequency bands. Alternatively, if the switch 133 is turned on, the first feed unit 131 and second feed unit 132 are connected to form a "⊤" shape, and thereby resonance is performed in a single frequency band which is different from the plurality of frequency bands described above.

FIGS. 1 to 4 illustrate an example of connecting the connection unit 122 to one end of the slot forming unit 123, but the location of the connection unit 122 may be varied, for example, as described below.

Figure 5:
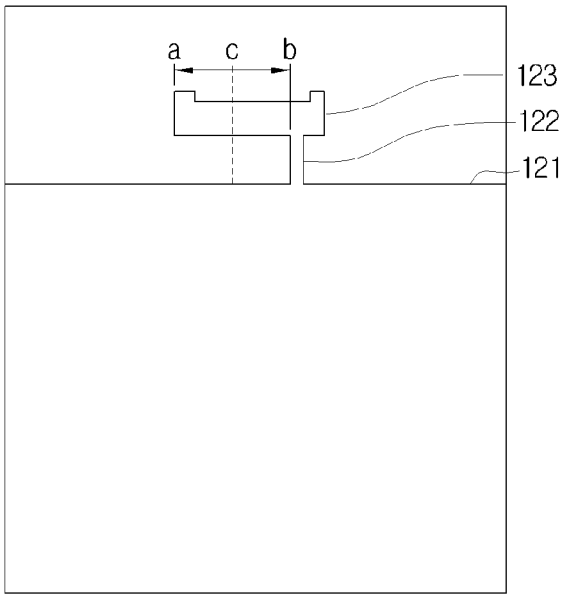
FIG. 5 is a configuration diagram illustrating another exemplary antenna for transmitting/receiving wireless communication signals.

FIG. 5 is a configuration diagram illustrating another exemplary configuration of an antenna for transmitting and receiving wireless communication signals. As shown in FIG. 5, the connection unit 122 may be connected at a certain distance from an end "a" of the slot forming unit 123, and the slot forming unit 123 may be generally rectangular or bar-shaped; however, portions of a side at both ends of the slot forming unit 123 protrude away from the ground unit 121 on the substrate. The location of the connection unit 122 may be varied from the location shown in FIG. 1. The feed unit 130 is positioned in an area on the second surface of the substrate 110 that corresponds to the same area on the first surface of the substrate 110 located between the centerline "c" of the slot 140 and the closed end of the slot 140 formed at the position "b" by a side of the connection unit 122 closing the end of the slot 140.

Figure 6:
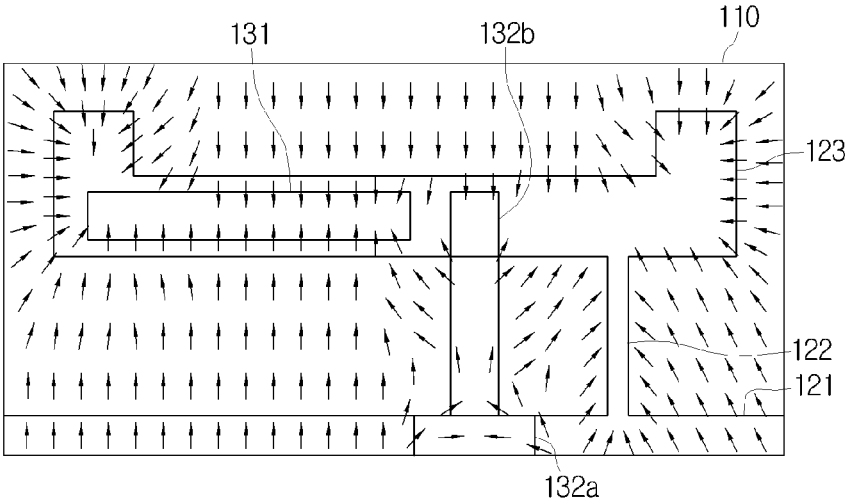
FIGS. 6, 7, and 8 are configuration diagrams illustrating patterns of electric fields according to the operation of a switch of an antenna.
Figure 7:
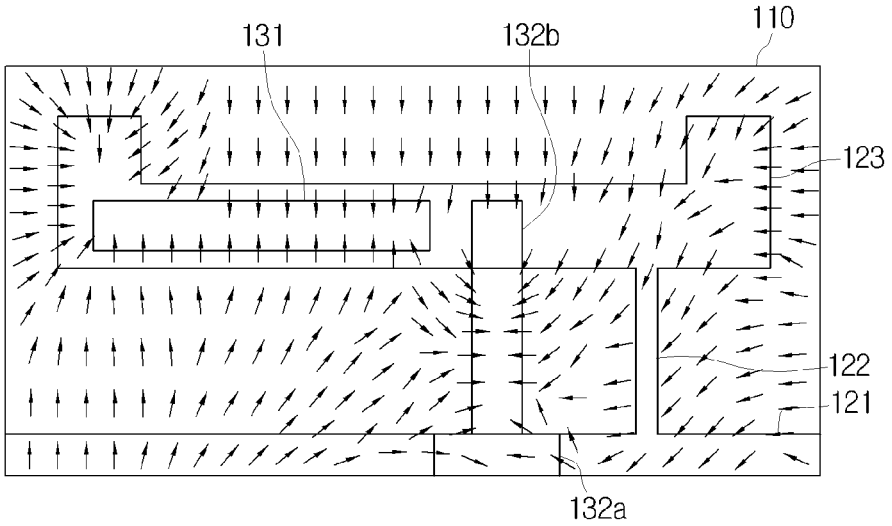
Figure 8:
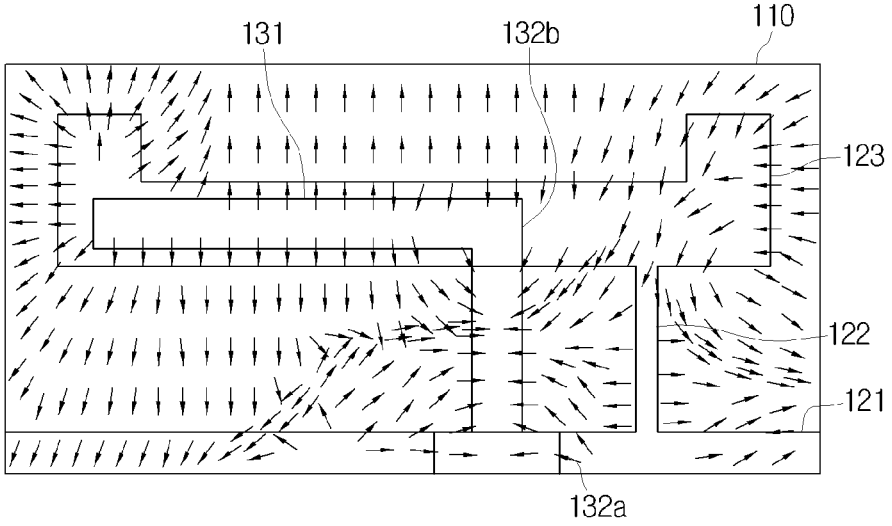

FIGS. 6, 7, and 8 are configuration diagrams illustrating patterns of electric field around the radiating unit 120 formed by turning on or off the switch 133.

FIG. 6 illustrates a pattern of an electric field in approximately the 2 GHz frequency band when the switch 133 of the feed unit 130 on the second surface of the substrate 110 is turned off and thereby only the second feed unit 132 is fed. FIG. 7 illustrates another pattern of an electric field in approximately the 5 GHz frequency band when the switch 133 is turned off. If the switch 133 is turned off, resonance is performed in two frequency bands to form the patterns of electric fields, for example, as shown in FIGS. 6 and 7. That is, since the feed unit 130 is arranged on the second surface of the substrate 110 in an area that corresponds to substantially the same area projected onto the first surface of the substrate 110 located between the centerline "c" of the slot 140 and the closed end of the slot 140 as described above, the magnetic current becomes 0 in an area of the slot 140. As a result, resonance is performed in at least two frequency bands when the switch 133 is turned off. However, FIG. 7 shows a pattern of electric field which is different from FIG. 6. That is, the return loss changes according to frequency bands.

FIG. 6 illustrates a pattern of an electric field in approximately the 3 GHz frequency band when the switch 133 is turned on. FIG. 8 shows a wider electric field focusing range than that shown in FIGS. 6 and 7. This is because the area of the feed unit 130 coupled with the radiating unit 120 increases when the switch 133 is turned on. As a result, resonance is performed in a single frequency band which is different from resonant frequency bands when the switch 133 is turned off.

Consequently, since resonance can be performed in three frequency bands according to whether the switch 133 is turned on or off, a multi-band antenna is provided.

Figure 9:
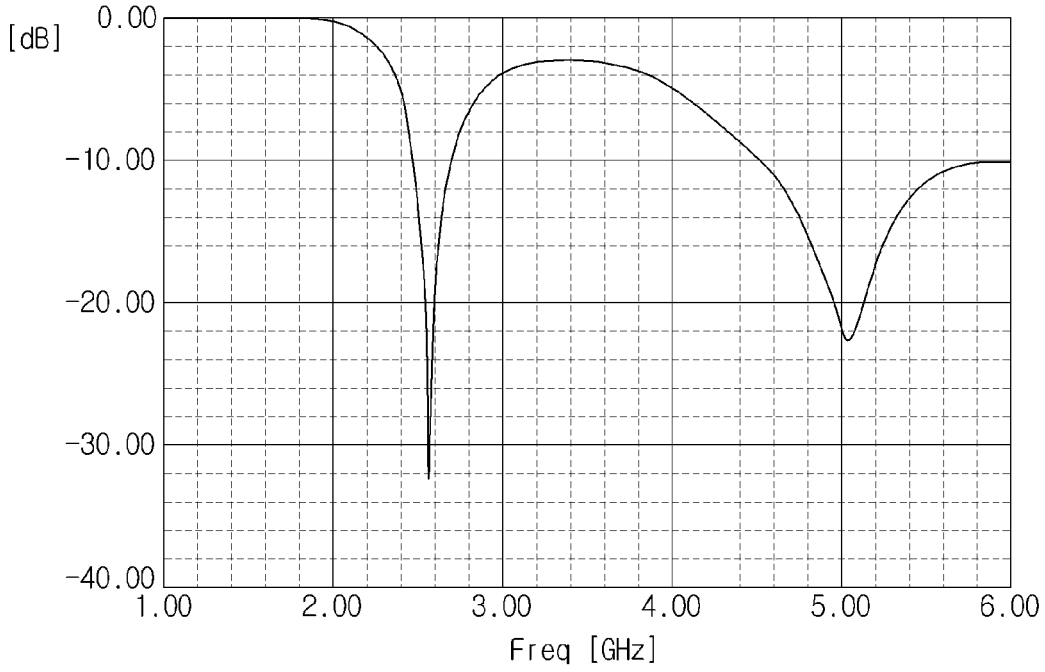
FIGS. 9 and 10 are graphs illustrating frequency bands which are resonated according to the operation a switch of the antenna.
Figure 10:
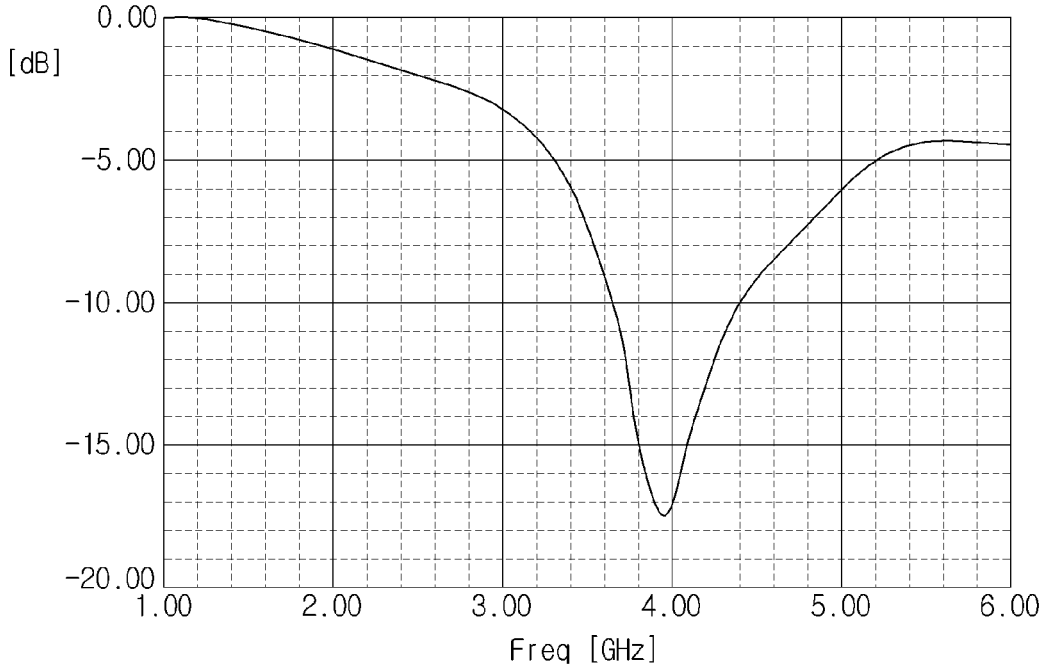

FIGS. 9 and 10 are graphs illustrating the features of return losses according to turning the switch 133 on or off. FIG. 9 shows the features of return loss when the switch 133 is turned off, where return losses are below −10 dB in around the 2.5 GHz and 5 GHz frequency bands.

FIG. 10 shows the features of return loss when the switch 133 is turned on, where return loss is below −10 dB in around the 3.9 GHz frequency band.

Figure 11:
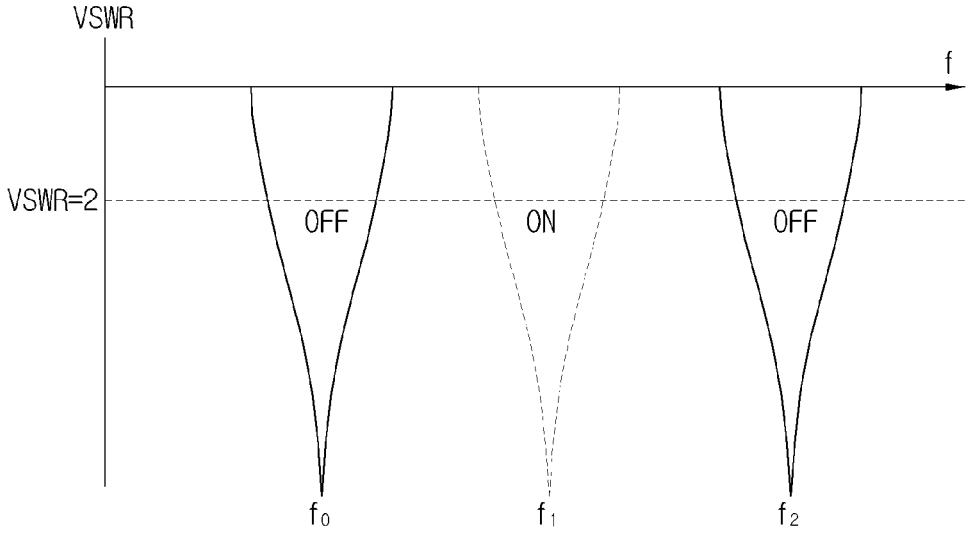
FIG. 11 is a graph illustrating frequency bands in which an antenna operates.

FIG. 11 is a graph illustrating the frequency bands in which an antenna operates. In FIG. 11, there are three sections having a voltage standing wave ratio (VSWR) below 2. Section $f_1$ represents when the switch 133 is turned on, sections $f_0$ and $f_2$ represent when the switch 133 is turned off. Sections $f_1$, $f_0$, and $f_2$ have the relationship where $f_1<f_0<f_2$. Therefore, the antenna is resonated in low, intermediate, high frequency bands, to be operated in multi-modes.

Figure 12:
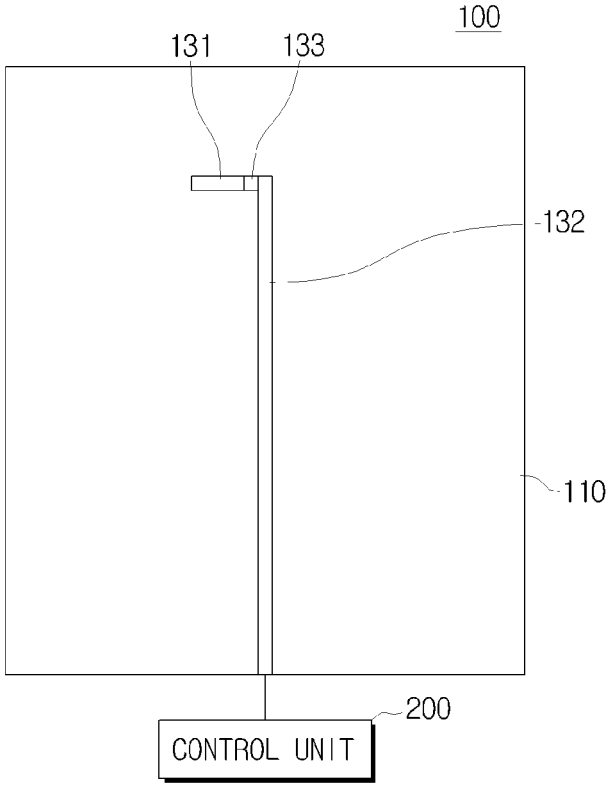
FIG. 12 is a configuration diagram illustrating an exemplary antenna system providing broad or multiple frequency bands.

FIG. 12 is a configuration diagram illustrating an exemplary antenna system to operate in broad or multiple frequency bands. The antenna system may be implemented in various types of wireless devices including cell phones, laptop computers, and PDAs.

With reference to FIG. 12, the antenna system includes an antenna 100 and a control unit 200. The antenna 100 may be implemented as one of the antennas described with reference to FIGS. 1 to 5. The control unit 200 outputs a control signal to the antenna 100 to turn on or off the switch 133 mounted in the antenna 100. That is, the control unit 200 controls the antenna 100 to operate in a plurality of frequency bands by turning off the switch 133, and the control unit 200 controls the antenna 100 to operate in a single frequency band from among a plurality of frequency bands by turning on the switch 133. The switch 133 may be located between the first feed unit 131 and the second feed unit 132. FIG. 12 shows only one switch, but two or more switches also may be used.

The switch 133 may be implemented, for example, as a PIN diode. The control unit 200 can control the switch 133 using a pulse of approximately 1 V over the threshold voltage of the PIN diode. Consequently, frequency tuning of the antenna 100 is performed using low power. The control unit 200 may be integrated on the same board as the antenna 100 so that the control unit 200 is connected to the switch 133 using a metal pattern or a wire.

As can be appreciated from the above description, an antenna which can operate in a plurality of frequency bands and an antenna system using the same can be implemented in miniaturized size. Therefore, the antenna system may be applied to handheld portable devices to transmit and receive signals in multiple frequency bands. In particular, frequency bands can be easily tuned using a switch.

A number of exemplary embodiments have been described above. Nevertheless, it will be understand that various modifications may be made. For example, suitable results may be achieved if the described techniques are performed in a different order and/or if components in a described system, architecture, device, or circuits are combined in a different manner and/or replaced or supplemented by other components or their equivalents. Accordingly, other implementations are within the scope of the following claims.

What is claimed is:

1. An antenna comprising:

a substrate including a first surface and a second surface;

a radiating unit formed on the first surface of the substrate;

a slot formed by the radiating unit that is closed at one end and open at an opposite end; and a feed unit formed on the second surface of the substrate in an area that corresponds to an area on the first surface of the substrate between the center of a length of the slot and the closed end of the slot and configured to be in an on or off position to resonate the antenna in a single frequency band in the on position and resonate the antenna in a plurality of frequency bands in the off position, wherein the feed unit has a perpendicular shape.

2. The antenna of claim 1, wherein the feed unit further comprises at least one switch to configure the size of an area of the feed unit.

3. The antenna of claim 1, wherein the radiating unit comprises:

a ground unit formed on the first surface of the substrate;

a slot forming unit formed on the first surface of the substrate at a predetermined distance from the ground unit to form the slot between the ground unit and the slot forming unit; and a connection unit to connect the slot forming unit and the ground unit and close an end of the slot.

4. The antenna of claim 3, wherein the connection unit extends from the ground unit to the slot forming unit at right angles to the slot forming unit and the ground unit.

5. The antenna of claim 3, wherein the ground unit, the slot forming unit, and the connection unit are an integral metal patterned unit.

6. The antenna of claim 3, wherein the feed unit comprises:

a first feed unit formed on the second surface of the substrate to correspond to at least one part of the slot forming unit on the first surface of the substrate; and a second feed unit formed in a substantially rectangular shape on the second surface of the substrate that passes through an area that corresponds to an area on the first surface between the center of the length of the slot and the closed end of the slot, wherein the first feed unit is perpendicular to the second feed unit.

7. The antenna of claim 6, wherein the feed unit further comprises at least one switch to connect and disconnect the first feed unit to the second feed unit.

8. The antenna of claim 7, wherein the switch is a Positive Intrinsic Negative (PIN) diode.

9. The antenna of claim 6, wherein the second feed unit comprises:

a first section formed in relation to the ground unit; and a second section formed in the area on the second surface that corresponds to the area on the first surface between the center of the length of the slot and the closed end of the slot, wherein a width of the second section is less than the width of the first section.

10. The antenna of claim 2, wherein the radiating unit is resonated in a plurality of frequency bands when the switch is turned off, and the radiating unit is resonated in a single frequency band which is different from the plurality of frequency bands when the switch is turned on.

11. The antenna of claim 7, wherein the radiating unit is resonated in a plurality of frequency bands when the switch is turned off, and the radiating unit is resonated in a single frequency band which is different from the plurality of frequency bands when the switch is turned on.

12. An antenna system comprising:

an antenna which comprises:

a slot including a length;

a radiating unit to form the slot and a closed end of the slot;

a feed unit positioned in relation to one side of the center of the length of the slot; and a switch to adjust the configuration of the feed unit; and a control unit to turn the switch on or off and resonate the antenna in a plurality of frequency bands when the switch is turned off, and to resonate the antenna in a single frequency band which is different from the plurality of frequency bands when the switch is turned on, wherein the feed unit has a perpendicular shape.

13. The antenna system of claim 12 further comprising:

a substrate having a first surface and a second surface, wherein the slot is formed on the first surface of the substrate and is closed at one end and open at another end, and the feed unit is formed on the second surface of the substrate and passes through an area that corresponds to an area on the first surface between the center of the length of the slot and the closed end of the slot.

14. The antenna system of claim 13, wherein the radiating unit comprises:

a ground unit formed on the first surface of the substrate;

a slot forming unit formed at a predetermined distance from the ground unit to form the slot between the slot forming unit and the ground unit; and a connection unit which connects the slot forming unit and the ground unit, and closes one end of the slot.

15. The antenna system of claim 14, wherein the connection unit extends from the ground unit to the slot forming unit forming a right angle with the slot forming unit.

16. The antenna system of claim 14, wherein the ground unit, the slot forming unit, and the connection unit are an integral metal patterned unit.

17. The antenna system of claim 14, wherein the feed unit comprises:

a first feed unit formed on the second surface of the substrate to correspond to at least one part of the slot forming unit on the first surface of the substrate; and a second feed unit formed in a substantially rectangular shape on the second surface of the substrate and passes through an area that corresponds to the area on the first surface between the center of the length of the slot and the closed end of the slot, wherein the first feed unit is perpendicular to the second feed unit, and the first feed unit and the second feed unit are connected or disconnected using the switch.

18. The antenna system of claim 17, wherein the second feed unit comprises:

a first section which corresponds to the ground unit; and a second section which corresponds to the area between the center of the slot and the closed end of the slot on the first surface of the substrate, wherein the width of the second section is less than the width of the first section.

19. An antenna system to transmit or receive wireless communication signals, comprising:

an antenna including:

a substrate having a first surface and a second surface opposite to the first surface;

a radiating unit formed on the first surface of the substrate including a rectangular slot formed by the radiating unit, the slot including a length having two ends including a closed end and an open end opposite the closed end and having a center line perpendicular to the length located between the open and closed ends; and a feed unit formed on the second surface of the substrate including a first portion formed at a location on the second surface corresponding to a same location on the first surface, wherein the same location is between the center line and the closed end of the slot; and a control unit to control the feed and resonate the antenna in a single frequency when the feed unit is in an on position and resonate the antenna in a plurality of frequencies different from the single frequency when the feed unit is in an off position, wherein the feed unit has a perpendicular shape.

20. The antenna system of claim 19, wherein the feed unit passes through an area on the second surface that corresponds to an area between the center line and the closed end of the slot on the first surface of the substrate.

21. The antenna system of claim 20, wherein radiating unit includes a ground unit, a slot forming unit spaced apart from the radiating unit parallel to the length of the slot, and a connection unit connecting the ground unit the slot forming unit to form the closed end of the slot.

22. The antenna system of claim 21 wherein the feed unit further comprises a second portion formed on the second surface at a right angle to the first portion of the feed unit in an area corresponding to an area on the first surface occupied by the slot forming unit.

23. The antenna system of claim 22 wherein the feed unit includes a switch to connect the first portion and the second portion when turned on, and wherein the radiating unit is resonated in a plurality of frequency bands when the controller turns the switch off, and the radiating unit is resonated in a single frequency band that is different from the plurality of frequency bands when the controller turns the switch on.

24. The antenna system of claim 22 wherein the second portion has a width and a length that is less than a width and a length of the slot forming unit.

25. The antenna system of claim 22, wherein the feed unit includes a third portion formed on the second surface of the substrate corresponding to a location of the ground unit on the first surface and connected to the first portion, wherein a width of the first portion is less than a width of the third portion.

* * * * *